US006886193B2

(12) United States Patent
McAlpine

(10) Patent No.: US 6,886,193 B2
(45) Date of Patent: May 3, 2005

(54) BATH WASTE

(75) Inventor: James Kenneth McAlpine, Glasgow (GB)

(73) Assignee: McAlpine & Company, Limited (GB)

( * ) Notice: Subject to any disclaimer, the term of this patent is extended or adjusted under 35 U.S.C. 154(b) by 0 days.

(21) Appl. No.: 10/382,730

(22) Filed: Mar. 4, 2003

(65) Prior Publication Data

US 2004/0172750 A1 Sep. 9, 2004

(51) Int. Cl.[7] ..... E03C 1/22
(52) U.S. Cl. ..... 4/680
(58) Field of Search ..... 4/679–685

(56) References Cited

U.S. PATENT DOCUMENTS 765,697 A * 7/1904 Bunting ..... 4/684
1,669,473 A * 5/1928 Kelso ..... 4/684
2,444,340 A * 6/1948 Donahue ..... 4/680

* cited by examiner

*Primary Examiner*—Charles E. Phillips
(74) *Attorney, Agent, or Firm*—Derek H. Maughan; Dykas, Shaver & Nipper

(57) ABSTRACT

A bath waste 10 is described including an overflow head 12 having an inlet, and an outlet portion 16 connectable to a down pipe 18, the head 12 and the outlet 16 being connected by a ball and socket joint 34. The joint 34 is factory-sealable to prevent users accessing the joint.

Embodiments of the invention may also include a faucet outlet on the head, and a lever-operated bath plug actuator.

The bath waste 10 is preferably produced from brass.

32 Claims, 4 Drawing Sheets

BATH WASTE

FIELD OF THE INVENTION

The present invention relates to a bath waste and overflow assembly.

BACKGROUND OF THE INVENTION

Bath waste and overflow assemblies are used to connect a water overflow outlet of a bathtub or similar bathing vessel to the normal waste water outlet, located in the base of the bathtub. The bath waste generally includes an overflow head assembly which is mounted to the water overflow outlet, and which is in turn connected to a down pipe connected by a T-piece or similar arrangement to a pipe section leading from the normal waste water outlet. The overflow head may be covered with a decorative cover.

As the walls of a bathtub are typically angled away from the vertical, the down pipe of the bath waste must generally be able to conform to this angle to reduce the volume of space occupied by the waste, while the overflow head must also be suitably oriented to be mountable to the overflow outlet. Since bathtubs may vary in the angle of the walls, it is advantageous to provide an adjustable bath waste, whereby the angle between the overflow head and the down pipe may be altered for use with different types of bathtub.

A known type of adjustable bath waste includes a section of down pipe formed from corrugated plastic tubing; such tubing may be bent by the installer to provide a desired angle, and will retain that angle. However, this tubing has two key perceived disadvantages: firstly, the interior surface of the down pipe is necessarily also corrugated, whereas smooth interior surfaces are perceived as less likely to trap particles and objects; and secondly, installers may wish to avoid the use of plastic components in certain situations, given the perception that plastic components provide a greater hazard during fires than metal components. Indeed, either or both of these perceived disadvantages may be reinforced by legislative standards set for plumbing installations in certain jurisdictions, such that in order to comply with plumbing codes only rigid pipework designs in solid metal with no flexibility are permissible.

It is among the objects of embodiments of the present invention to obviate or alleviate one or more of these or other disadvantages of conventional bath wastes.

SUMMARY OF THE INVENTION

According to a first aspect of the present invention, there is provided a bath waste assembly comprising an overflow head including an inlet adapted to be secured to an overflow of a bathtub; and an outlet for attaching to a down pipe; the overflow head being connected to the outlet by means of a swivel joint.

The use of a swivel joint permits the relative orientation of the inlet and outlet to be adjusted as desired, while using rigid down pipes and the like. The swivel joint must provide for relative movement of the overflow head and outlet in at least one plane, and preferably two planes. The swivel joint may also provide for relative rotation of the overflow head and outlet about an axis.

The inlet may further comprise an inlet plate including apertures to permit the flow of fluid therethrough. In use, the plate is interposed between the inlet and a bathtub or the like. An upper portion of the inlet plate may be constructed so as to include no apertures therethrough. It has been found, surprisingly, that such a construction increases the flow rate of water through the inlet. Preferably the closed upper portion of the inlet plate covers between 10 to 30% of the total area of the inlet plate; conveniently around 20%. Tests have demonstrated that a plate of this construction is able to achieve flow rates of 8 to 10 liters per minute compared with conventional constructions of up to 6 or 7 liters per minute.

Preferably the inlet is constructed to permit fluid flow rates therethrough of at least 8 liters per minute.

Preferably the assembly further comprises compression means for compressing parts of the joint together. This allows the joint to be secured in position once the correct alignment is found, and also improves the watertightness of the joint. Preferably the compression means comprises a nut mounted on one of the overflow head and the outlet, and a threaded portion located on the other of the overflow head and the outlet; tightening of the nut thus serves to bring together the component parts of the joint. The nut may be in the form of a ring. The compression means may further comprise a resilient O-ring or the like; this provides a secure water seal and reduces the risk of damaging the assembly components when the nut is tightened. The compression means is preferably fixable in position, to prevent the compression means from working loose unwantedly. The compression means may be fixable to prevent movement of the joint; or may be fixable in a position which still permits some movement of the joint. Preferably some movement of the joint is permitted when the compression means is fixed. Where the compression means comprises a nut or the like, the compression means may be fixed by immobilising the nut on the thread. In a preferred embodiment of the invention, the compression means is fixed during manufacture of the assembly; that is, the assembly is a "factory-sealed" unit. This avoids the need for installers to fix the compression means of the unit themselves, and so may improve reliability of the joint, as well as alleviating customers' concerns about such reliability. The compression means may be fixed by means of welding, glue or other adhesives, tape, and the like.

Preferably the assembly further comprises a down pipe connected to the outlet. The down pipe may be removably or permanently connected to the outlet.

In certain embodiments of the invention, the swivel joint may be detachable from the outlet and/or the overflow head. This allows the assembly to be produced and sold as a set of parts which may be subsequently assembled by the installer.

Preferably the assembly comprises predominantly metal. A preferred metal is brass, although aluminium alloy, copper, or stainless steel may be used in certain embodiments.

Preferably the swivel joint comprises a ball and socket joint. Conveniently the joint comprises a ball located on the outlet, and a socket located on the head; the inverse construction may be used in certain embodiments.

Preferably the overflow head further comprises a plug actuator comprising a rotary spindle operably associated with means for raising and lowering a plug disposed adjacent a down pipe. Actuation of the spindle will thus raise and lower the plug, so permitting the bathtub to be filled or emptied. Preferably the spindle is actuated by means of a lever; conventional plug assemblies make use of a rotatable cover or plate to actuate a plug, which can prove difficult to operate for elderly or disabled individuals. The provision of a lever-operated spindle allows these individuals to operate the spindle more easily. Conveniently the spindle may be actuated by the application of less than around 30 pounds of force thereto. The means for raising and lowering a plug may comprise a lever raised and lowered by means of the rotary spindle.

Preferably the assembly further comprises a plug and waste disposed adjacent the down pipe. The plug may conveniently be raised and lowered by means of a construction as described above. The waste conveniently is provided in combination with a strainer plate or the like, to prevent solid objects from passing the waste. The strainer plate is preferably removable from the waste; conveniently the plate is vertically removable from the waste. The plate may conveniently be secured to the plug, such that the plate and plug may be removed from the waste together.

Preferably the overflow head further comprises a faucet outlet. This allows the overflow head to be used as a faucet for filling a bathtub, such that no separate faucet need be provided. This can improve the aesthetic appearance of a bathtub. Preferably the faucet outlet is provided in combination with a lever-operated plug actuator; unlike conventional plate or cover-operated plug actuators, the use of a lever permits the faucet outlet and a portion of the lever to be concealed behind a single cover, which does not need to be rotatable. Preferably the overflow head further comprises a cover mounted to conceal the faucet outlet. Preferably the cover is mounted on a pair of pins provided on the head. Conveniently the pins are of different lengths, with corresponding receiving portions located on the cover; this helps to ensure correct fitting and orientation of the cover, and allows an installer to locate the cover in the appropriate position with little difficulty. The pins may also or instead be of different diameters, to achieve a similar effect. Preferably the cover is retained on the head by means of a sprung-pin retainer; conventional covers are secured by means of screws or the like, which can be difficult for installers to access. The cover may further be asymmetrically-shaped; this allows a range of aesthetic appearances to be achieved by different covers which are unavailable to conventional covers which must be rotatable, and so are generally symmetrical.

Preferably the overflow head further comprises a rear cover mounted thereon, to restrict access into the interior thereof. The rear cover may include a thread which engages with a corresponding thread provided on the overflow head, to allow the rear cover to be screwed on or off the head. Conventional covers may be secured by means of individual screws or the like, which can be difficult to access; a threaded rear cover overcomes this difficulty.

According to a second aspect of the present invention, there is provided a bath waste assembly comprising an overflow head including an inlet adapted to be secured to an overflow of a bathtub; an outlet for attaching to a down pipe; a plug actuator located on the overflow head comprising a rotary spindle operably associated with means for raising and lowering a plug disposed adjacent a down pipe; and wherein the overflow head further comprises a faucet outlet.

The inlet may further comprise an inlet plate including apertures to permit the flow of fluid therethrough. In use, the plate is interposed between the inlet and a bathtub or the like. An upper portion of the inlet plate may be constructed so as to include no apertures therethrough. It has been found, surprisingly, that such a construction increases the flow rate of water through the inlet. Preferably the upper portion of the inlet plate covers between 10 to 30% of the total area of the inlet plate; conveniently around 20%. Tests have demonstrated that a plate of this construction is able to achieve flow rates of 8 to 10 liters per minute compared with conventional constructions of up to 6 or 7 liters per minute.

Preferably the inlet is constructed to permit fluid flow rates therethrough of at least 8 liters per minute.

Preferably the plug actuator further comprises a lever for rotation of the spindle.

Preferably the overflow head further comprises a cover mounted thereto to conceal the faucet outlet.

Preferably the assembly further comprises a plug and waste disposed adjacent the down pipe. The plug may conveniently be raised and lowered by means of a construction as described above. The waste conveniently is provided in combination with a strainer plate or the like, to prevent solid objects from passing the waste. The strainer plate is preferably removable from the waste; conveniently the plate is vertically removable from the waste. The plate may conveniently be secured to the plug, such that the plate and plug may be removed from the waste together.

According to a further aspect of the present invention, there is provided a waste assembly comprising an outlet body and a plug for location in the body, the plug being adapted to be moved vertically to open and seal the outlet; the assembly further comprising a strainer plate located within the outlet.

Preferably the strainer plate is removable from the outlet. Conveniently the strainer plate is adapted to rest on a lip or other protrusion formed within the outlet.

The strainer plate may be conveniently attached to the plug. The plug and plate are preferably together removable from the outlet. This provides for ease of cleaning of the waste assembly.

Preferably the assembly further comprises means for raising and lowering the plug; conveniently this may be in the form of a sprung extendable barrel assembly on which the plug is mounted. Such assemblies are commonly known as 'clicker' assemblies, or 'push-push' assemblies. This arrangement allows for the plug to be raised or lowered by a simple push to the plug, so providing for ease of actuation of the device. Other means for raising and lowering the plug may be used, for example, actuated lever assemblies and the like.

BRIEF DESCRIPTION OF THE DRAWINGS

These and other aspects of the present invention will now be described by way of example only and with reference to the accompanying drawings, in which.

DETAILED DESCRIPTION OF THE DRAWINGS

Figure 1:
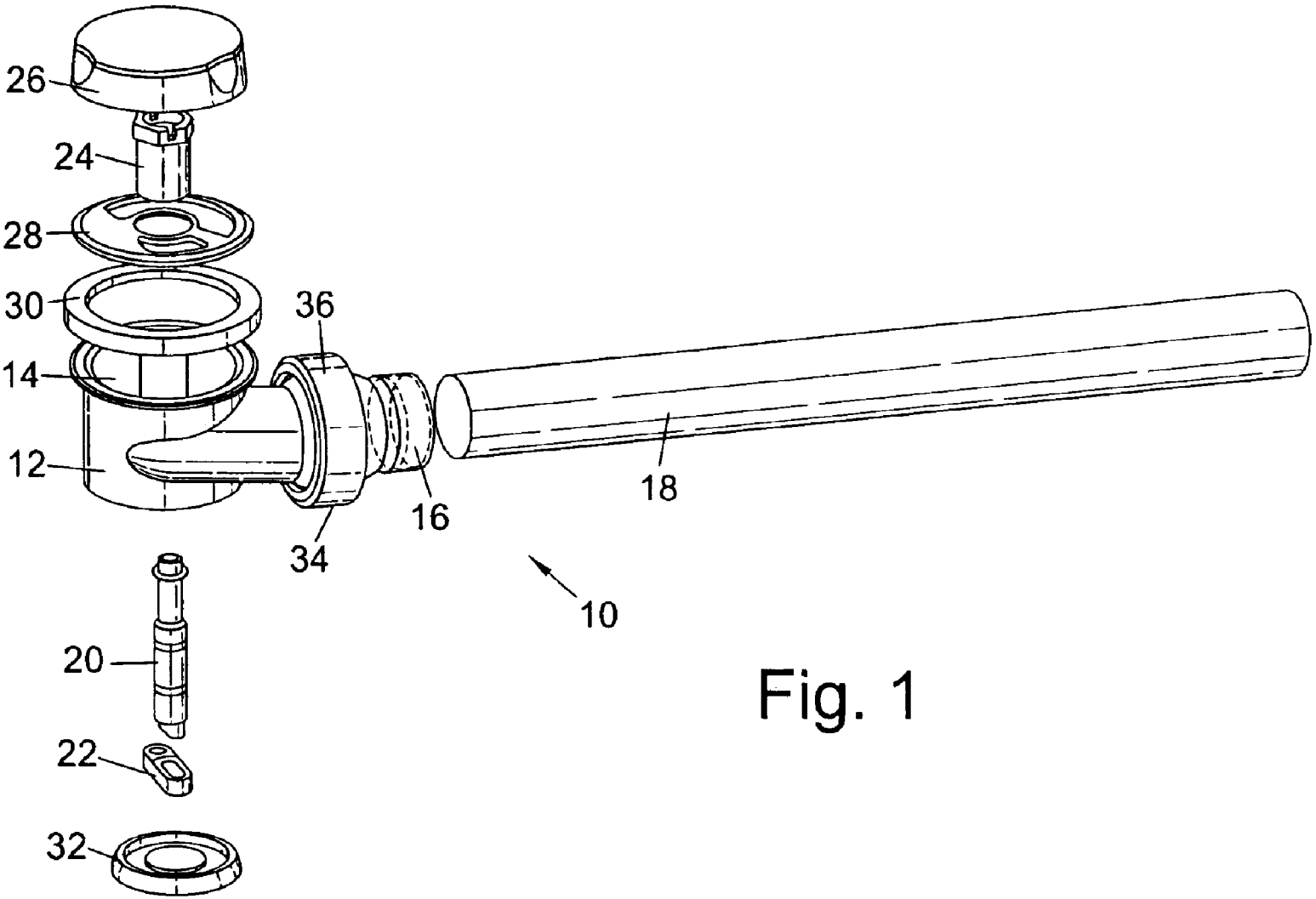
FIG. 1 shows an exploded view of a bath waste assembly in accordance with an embodiment of the present invention.

Referring first of all to FIG. 1, this shows an exploded view of a bath waste assembly in accordance with an embodiment of the present invention. The assembly 10 is produced generally from brass, and includes an overflow head 12 having an inlet 14, and an outlet portion 16 which is connected to a down pipe 18.

Within the overflow head 12 is located a rotary spindle 20 which carries a cam member 22; in use, the cam member 22 carries a control cable (not shown) which extends from the overflow head 12 along the down pipe 18 to a lever on which is carried a bath plug. The rotary spindle 20 extends through the overflow head 12 and through a ferrule 24, and is mounted to a rotary cover 26. Rotation of the cover 26 causes movement of the cam member 22, and hence of the lever and bath plug to raise and lower the plug.

Mounted between the ferrule 24 and the overflow head 12 are an inlet cover 28, to prevent large objects from blocking the inlet 14, and a rubber O-ring 30 to seal the overflow head 12 to a bathtub. The ferrule 24 serves to hold the cover and head together, with the cover and head being located on opposite sides of a bathtub wall, while the O-ring 30 serves to prevent damage to the bathtub from the head; this arrangement holds the waste securely in position. The inlet cover 28 is apertured to permit the flow of water therethrough. It will be noted that an upper portion of the inlet cover is blanked out, in that this portion lacks apertures. It has been found that surprisingly such an arrangement actually increases the flow rate of water therethrough. It is believed that this result arises from a siphonic effect occurring within the head and down pipe due to the blanked out portion. It is thought that a blanked out portion of some 20% of the total area of the cover 28 provides a significant improvement in flow rates, from 6–7 liters/minute in a conventional arrangement to 8–10 liters/minute with the present arrangement, in certain configurations of the invention. The provision of a blanked out portion may also have the effect of lowering the aperture height of the outlet, which may be of assistance in increasing flow rates.

A screw-on cover 32 is mounted to the rear of the head 12, to retain and protect the spindle 20 and cam member 22 within the head 12.

The overflow head 12 is joined to the outlet 16 via a ball and socket joint 34; one end of the overflow head 12 forms a ball shape, while the corresponding end of the outlet 16 forms a socket which receives the ball. The joint includes a brass circular nut 36 within which is located a rubber O-ring; the nut 36 is retained on a flange on the outlet portion, and screws onto a thread located on the overflow head 12, and compresses the two parts of the ball and socket joint together. The nut 36 is preferably fixed or "factory sealed" onto the joint, to prevent users from disassembling the joint. Fixing may take place using glue or welding. The tightness of the fixed nut is sufficient to permit a degree of movement of the ball and socket joint 34, to allow the relative alignment of the head 12 and outlet 16 to be adjusted.

Figure 2:
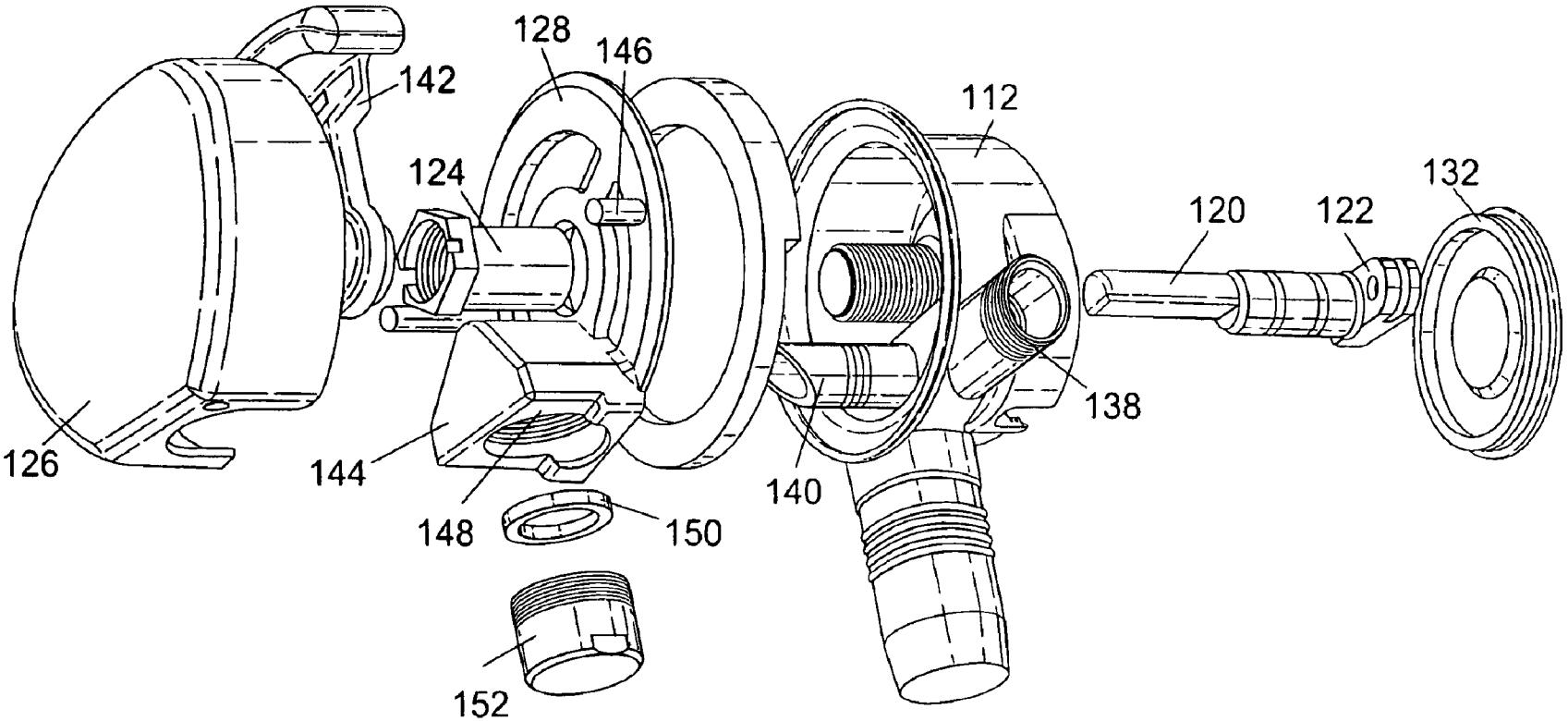
FIGS. 2 and 3 show exploded perspective and side views respectively of an alternate overflow head of a bath waste assembly in accordance with a further embodiment of the present invention.
Figure 3:
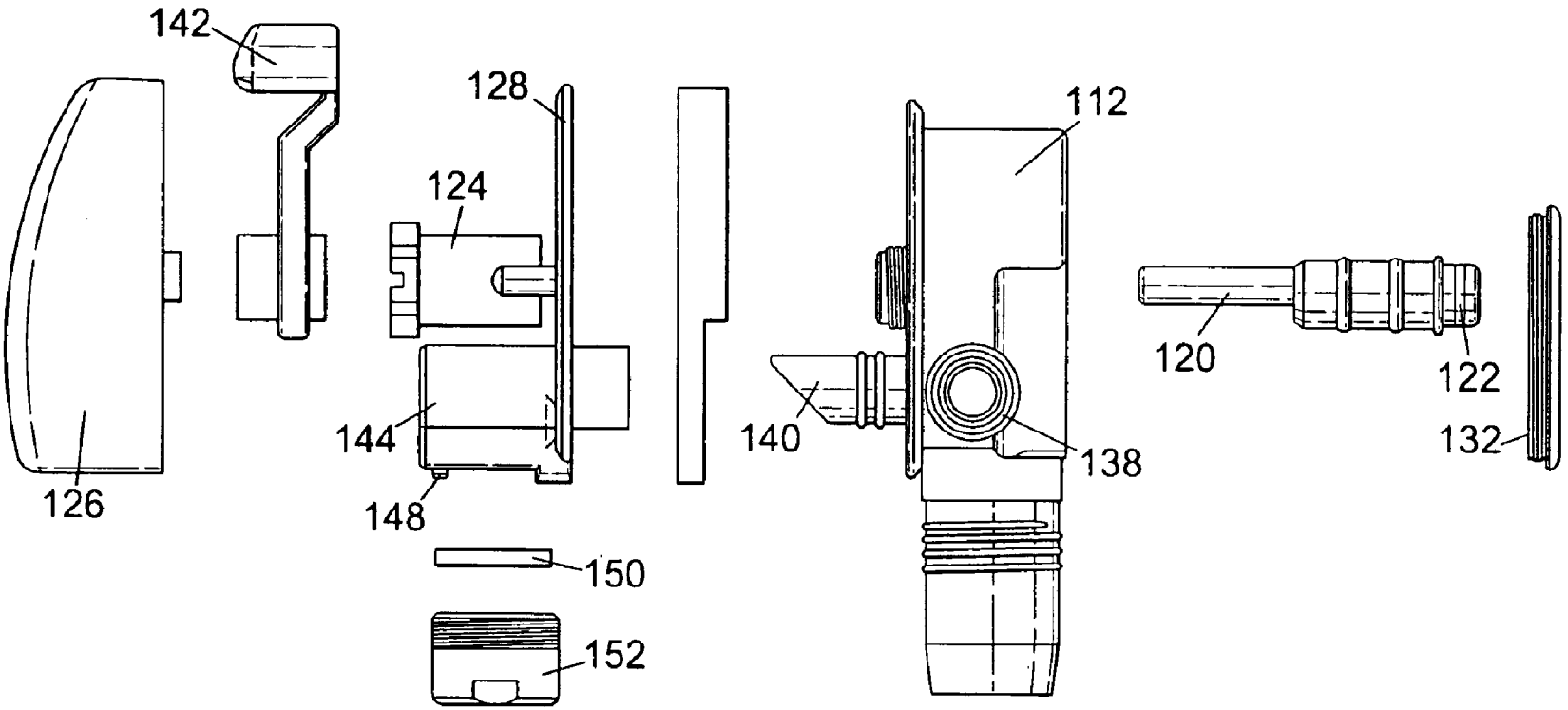

An alternative overflow head 112 is shown in FIGS. 2 and 3. The head 112 includes a similar spindle 120 and cam member 122, and a threaded rear cover 132. The spindle 120 passes through a ferrule 124, and is actuated by a lever 142, rather than a rotatable cover as with the embodiment of FIG. 1.

The head 112 further includes a faucet water inlet 138 and a faucet outlet 140. The faucet outlet 140 extends into a corresponding outlet portion 144 provided on the inlet cover 128. In the example illustrated, the outlet portion 144 is provided with a seal ring 150 and an aerator 152. The inlet cover 128 also carries a pair of unequal-length pins 146, which receive a head cover 126 for concealing the faucet outlet 144 and the lever 142. The unequal-length pins 146 ensure that the cover 126 may only be received thereon in a particular orientation. The pins also make fitting of the cover 126 relatively straightforward—the cover is placed first of all on the longer of the two pins, and then rotated into position to align with the second pin. This avoids the need to align both pins at once. The cover 126 once mounted is non-rotatable, and includes a shaped recess for receiving the outlet portion 144, and is mounted sufficiently far forward of the plate 128 to permit movement of the lever 142. The cover 126 may be secured in position by means of a sprung pin 148 mounted on the outlet portion 144; this avoids the need for fitting screws or the like to be provided, which may be awkward to access and tighten.

It is the provision of a lever-actuated plug which allows the faucet outlet 140 and cover 126 to be provided on this overflow head 112, since there is no need for the cover 126 to be rotatable. This also permits the cover 126 to be asymmetric, with an aesthetically pleasing profiled shape, rather than the conventional circular or similar shape of rotatable covers.

Figure 4:
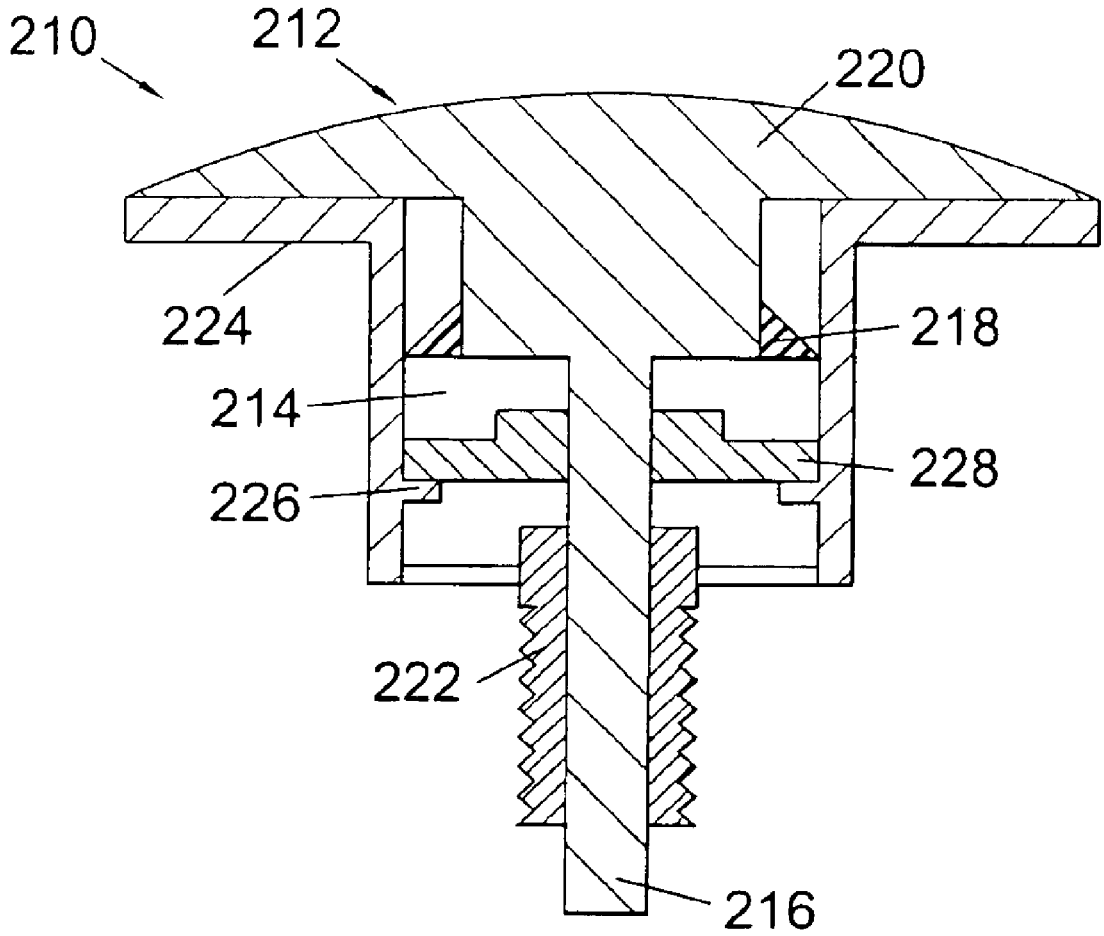
FIG. 4 shows a sectional view of a waste assembly in accordance with a further embodiment of the present invention.

Referring now to FIG. 4, this shows a sectional view of a waste outlet 210 in accordance with a further embodiment of the present invention. The waste outlet 210 includes a plug 212 and an outlet body 214. The plug 212 includes a spindle 216 which is vertically movable by a plug actuation mechanism (not shown), and to which is attached a rubber seal lip 218 and a plug top 220. The spindle 216 extends through the base of the outlet body 214, and is received within a screw 222 including a through bore, the screw 222 being suitable for engaging the outlet body 214 to a bathtub (not shown). The plug top 220 rests on a flange 224 formed on the outlet body, which in use itself rests on a bathtub lip.

The outlet body 214 further includes a lip 226 formed around an inner circumference thereof. On the lip 226 rests a strainer plate 228, which includes a number of apertures through which water may pass, but which are arranged to prevent solid objects from passing. The strainer plate 228 includes a central bore through which the spindle 216 is received in an interference fit. When cleaning of the waste 210 is necessary, the plug top 212 may be grasped and the plug lifted upwardly from the outlet body 214; the strainer plate 228 will also be lifted with the plug, so allowing access to the interior of the waste for cleaning, as well as cleaning of the strainer plate and plug. This arrangement thus provides for an easy-to-clean waste which includes a strainer to prevent unwanted foreign objects from entering the waste, in combination with an actuable plug. The waste is also relatively compact, since the strainer is provided between the plug and the outlet. Such an arrangement has not heretofore been possible to achieve without significant disadvantages.

It will be understood that the foregoing is illustrative of the invention, and that numerous variations and modifications may be made to the assembly without departing from the scope of the invention. For these reasons, the appended claims should be referred to, to determine the true scope of the invention.

What is claimed is:

1. A bath waste assembly comprising an overflow head including an inlet adapted to be secured to an overflow of a bathtub and defining an inlet opening, an inlet plate extending over the inlet opening, the inlet plate including apertures to permit the flow of liquid, an upper portion of the inlet plate including no aperture, thereby increasing the flow rate of liquid through the inlet opening; and an outlet for attaching to a down pipe; the overflow head being connected to the outlet by means of a swivel joint.

2. The bath waste assembly of claim 1, further comprising compression means for compressing parts of the joint together.

3. The assembly of claim 2, wherein the compression means comprises a nut mounted on one of the head and the outlet, and a threaded portion located on the other of the head and the outlet.

4. The assembly of claim 2, wherein the compression means further comprises a resilient O-ring.

5. The assembly of claim 2, wherein the compression means is fixable in position.

6. The assembly of claim 5, wherein some movement of the joint is permitted when the compression means is fixed in position.

7. The assembly of claim 5, wherein the compression means is fixed in position during manufacture of the assembly.

8. The assembly of claim 1, further comprising a down pipe connected to the outlet.

9. The assembly of claim 1, wherein the joint is detachable from one of the outlet and the head.

10. The assembly of claim 1, wherein the assembly comprises predominantly brass.

11. The assembly of claim 1, wherein the swivel joint comprises a ball and socket joint.

12. The assembly of claim 11, wherein the ball and socket joint comprises a ball located on the head, and a socket located on the outlet.

13. The assembly of claim 1, wherein the head further comprises a plug actuator comprising a rotary spindle adapted for association with means for raising and lowering a plug disposed adjacent a down pipe.

14. The assembly of claim 13, wherein the actuator further comprises a lever for actuating the spindle.

15. The assembly of claim 13, wherein the means for raising and lowering a plug comprises a lever raised and lowered by means of the rotary spindle.

16. The assembly of claim 1, wherein the head further comprises a faucet outlet.

17. The assembly of claim 16, wherein the head further comprises a lever-operated plug actuator.

18. The assembly of claim 17, wherein the head further comprises a cover mounted to conceal the faucet outlet.

19. The assembly of claim 18, wherein the cover is mounted on a pair of pins provided on the head.

20. The assembly of claim 19, wherein the pins are of different lengths, with corresponding receiving portions located on the cover.

21. The assembly of claim 19, wherein the pins are of different diameters.

22. The assembly of claim 19, wherein the pins are of equal diameters.

23. The assembly of claim 18, wherein the cover is retained on the head by means of a sprung-pin retainer.

24. The assembly of claim 1, wherein the head further comprises a rear cover mounted thereon.

25. The assembly of claim 24, wherein the rear cover includes a thread which engages with a corresponding thread provided on the head.

26. The assembly of claim 1, further comprising a plug and waste for disposal adjacent a down pipe.

27. The assembly of claim 26, wherein the waste is provided in combination with a strainer plate.

28. The assembly of claim 27, wherein the strainer plate is vertically removable from the waste.

29. The assembly of claim 28, wherein the strainer plate is secured to the plug.

30. The apparatus of claim 1, wherein the upper portion of the inlet plate covers between 10 to 30% of the total area of the inlet plate.

31. The apparatus of claim 1, wherein the inlet is constructed to permit fluid flow rates therethrough of at least 8 liters per minute.

32. A bath waste assembly comprising an overflow head including an inlet adapted to be secured to an overflow of a bathtub and defining an inlet opening; an inlet plate extending over the inlet opening, the inlet plate including apertures to permit the flow of liquid, an upper portion of the inlet plate including no aperture thereby increasing the flow rate of liquid through the inlet opening.

* * * * *